US007268325B1

(12) United States Patent
Chuang

(10) Patent No.: US 7,268,325 B1
(45) Date of Patent: Sep. 11, 2007

(54) METHOD OF MAKING FLEXIBLE SHEET HEATER

(75) Inventor: Kuo-Chang Chuang, Taichung (TW)

(73) Assignee: Linkwin Technology Co., Ltd. (TW)

( * ) Notice: Subject to any disclaimer, the term of this patent is extended or adjusted under 35 U.S.C. 154(b) by 0 days.

(21) Appl. No.: 11/584,567

(22) Filed: Oct. 23, 2006

(51) Int. Cl.
*H05B 3/34* (2006.01)

(52) U.S. Cl. ..... 219/545; 219/528; 219/529; 219/543; 219/549; 219/202; 219/211; 219/212; 219/217; 219/490; 219/548; 219/497; 219/569

(58) Field of Classification Search ..... 219/528–529, 219/543, 545, 549, 497, 548, 569, 202, 211, 219/212, 217, 490
See application file for complete search history.

(56) References Cited

U.S. PATENT DOCUMENTS 6,172,344 B1 1/2001 Gordon et al.

6,483,087 B2 11/2002 Gardner et al.

FOREIGN PATENT DOCUMENTS

TW 374539 11/1999

*Primary Examiner*—Shawntina Fuqua
(74) *Attorney, Agent, or Firm*—Browdy and Neimark PLLC

(57) ABSTRACT

A method of making a flexible sheet heater includes the steps of (i) bonding an electrically conductive fabric and an support member formed of a PET film and a layer of acrylic together, ii) stamp-cutting the electrically conductive fabric to form a heating element having a predetermined loop, iii) attaching two electrical terminals to two distal ends of the heating element respectively, iv) bonding a first flexible protective sheet member to one side of the heating element opposite to the PET film, v) removing the PET film from the heating element; and vi) bonding a second flexible protective sheet member to the other side of the heating element opposite to the first flexible protective sheet member so that the heating element is sandwiched between the first and second flexible protective sheet members.

5 Claims, 8 Drawing Sheets

METHOD OF MAKING FLEXIBLE SHEET HEATER

BACKGROUND OF THE INVENTION

1. Field of the Invention

The present invention relates to a method of making a flexible sheet heater for use in waist pads, waist bandages, and clothes and more particularly, to a method of making a flexible sheet heater by using an electrically conductive fabric.

2. Description of the Related Art

Flexible, electrically conductive sheet heaters are intensively used in clothes, kneepads, gloves, shoe pads, ear covers, waist pads, and etc. to keep the user warm.

A conventional flexible, electrically conductive sheet heater is known comprising two flexible heat-resistant insulative sheets, a metal loop formed of a thin metal sheet member by chemical etching or stamping and sandwiched in between the two flexible heat-resistant insulative sheets, and two electrical terminals respectively connected to the two distal ends of the metal loop and extending out of the two flexible heat-resistant insulative sheets for enabling an electric current to be transmitted through the metal loop to generate heat. There is known another conventional structure of flexible, electrically conductive sheet heater, which comprises a first flexible heat-resistant insulative sheet, a carbon loop printed on the first flexible heat-resistant insulative sheet, a second flexible heat-resistant insulative sheet bonded to the first flexible heat-resistant insulative sheet to have the carbon loop be sandwiched in between the two flexible heat-resistant insulative sheets, and two electrical terminals respectively connected to the two distal ends of the carbon loop and extending out of the two flexible heat-resistant insulative sheets.

The aforesaid two different electrically conductive sheet heaters have light and thin characteristics and can be slightly curved; however, they cannot be folded up. Because the aforesaid two different electrically conductive heater systems are not foldable, their application is limited.

There is also known a flexible, electrically conductive sheet heater, which has an electrically conductive fabric, for example a carbon fiber fabric, sandwiched in between two flexible heat-resistant insulative coverings and provided with a power input structure. This design of flexible, electrically conductive sheet heaters has light and thin characteristics and is foldable for different applications. Exemplars of these electrically conductive fabric-based heater designs are seen in Taiwan Patent Publication No. 374,539, U.S. Pat. No. 6,172,344, and U.S. Pat. No. 6,483,087.

According to Taiwan Patent Publication No. 374,539, the heater comprises an electrically conductive rectangular carbon fiber fabric, two elongated conductive copper strips respectively affixed to two sides of the carbon fiber fabric, two electric wires respectively connected to the copper strips, and two plastic cover films respectively covered on the top and bottom sides of the carbon fiber fabric and the copper strips. According to this design, the conductivity of the copper strips is superior to the carbon fiber fabric, resulting in a high contact resistance between the two copper strips and the carbon fiber fabric. Further, because the surface of the carbon fiber fabric is not a smooth surface such that the whole surface of each copper strip is not fully kept in contact with the carbon fiber fabric, an excessive high temperature may be produced between the copper strips and the carbon fiber fabric. Taiwan Patent Publication No. 374,539 does no provide any measures to eliminate the aforesaid problems.

U.S. Pat. No. 6,172,344 discloses continuous and batch-based conductive element fabrication methods by sandwiching a carbonized fabric with electrical terminals between layers of plastic insulating material. However, U.S. Pat. No. 6,172,344 does not teach the way of keeping the carbonized fabric between the two layers of plastic insulating material in a smooth manner.

U.S. Pat. No. 6,483,087 discloses a process of making a heater by: combining a layer of electrically conductive fabric with two metal foil bus bars, securing the bus bars to the conductive fabric, drawing the conductive fabric layer containing bus bars between two layers of thermoplastic film forming a sandwich structure, feeding the sandwich structure through a pinch roller preheated at a predetermined temperature and thickness to cause gelling of the thermoplastic layers, and consolidating the conductive fiber layer to form a single sheet heater. According to this method, it is difficult to cut the layer of electrically conductive fabric into the desired curved shape. When cutting the layer of electrically conductive fabric, the carbonized fiber structure of the layer of electrically conductive fabric tends to be stretched and damaged, and the layer of electrically conductive fabric may be deformed easily when pulled toward the layers of thermoplastic film.

SUMMARY OF THE INVENTION

The present invention has been accomplished under the circumstances in view. It is therefore one object of the present invention to provide a method of making a flexible sheet heater, which enables an electrically conductive fabric to be rapidly and smoothly sandwiched in between two protective sheet members.

To achieve this object of the present invention, the method of making a flexible sheet heater comprises the steps of: a) preparing an electrically conductive fabric; b) preparing a support member having a PET (polyethylene terephthalate) film and a layer of acrylic glue covered on one side of the PET film; c) joining the electrically conductive fabric and the support member together by adhering the layer of acrylic glue to one side of the electrically conductive fabric through a pressing process; d) cutting the electrically conductive fabric to form a heating element having a predetermined loop pattern by a stamping process; e) applying a conducting glue to each of two distal ends of the heating element and fixedly bonding a respective electrical terminal to the conducting glue at each of the two distal ends of the heating element; f) bonding a first flexible protective sheet member to one side of the heating element opposite to the PET film through a hot press; g) removing the PET film from the heating element; and h) bonding a second flexible protective sheet member to one side of the heating element opposite to the first flexible protective sheet member such that the heating element is sandwiched between the first and second flexible protective sheet members.

DETAILED DESCRIPTION OF THE INVENTION

Figure 1:
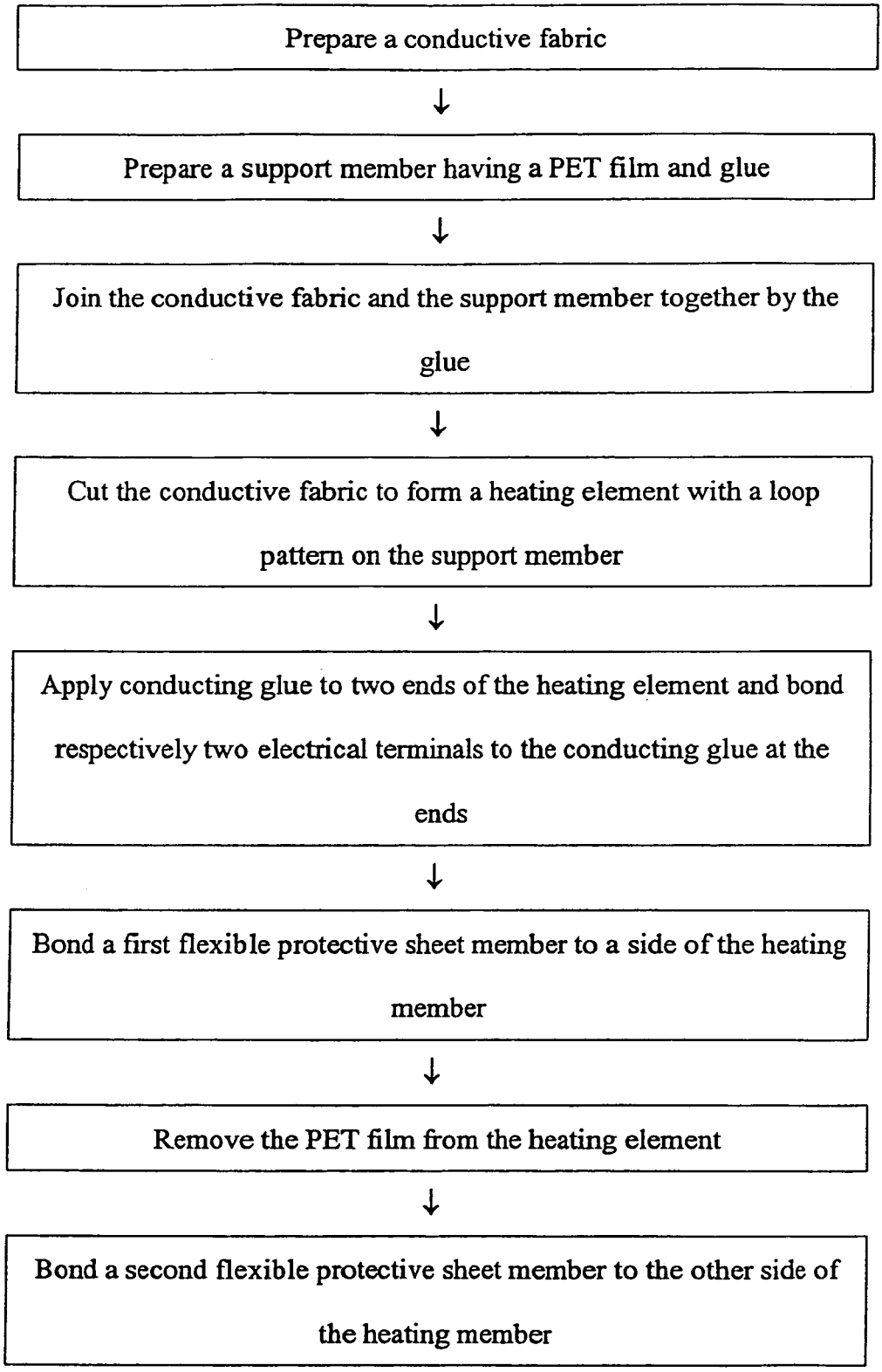
FIG. 1 is a flow chart showing the steps of the method of making a flexible sheet heater according to a preferred embodiment of the present invention.
Figure 2:
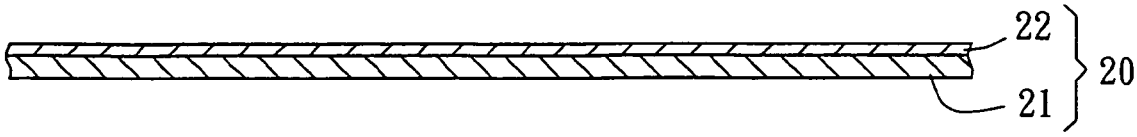
FIG. 2 is a sectional view of a part of a support member prepared in step b) of the method of making the flexible sheet heater according to the preferred embodiment of the present invention.
Figure 3A:
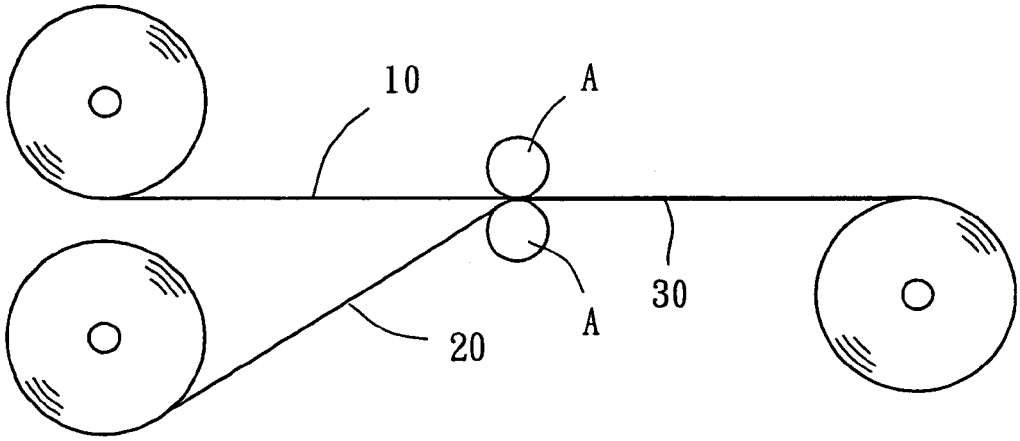
FIGS. 3A and 3B are schematic drawings showing the performance of step c) of the method of making the flexible sheet heater according to the preferred embodiment of the present invention.
Figure 3B:
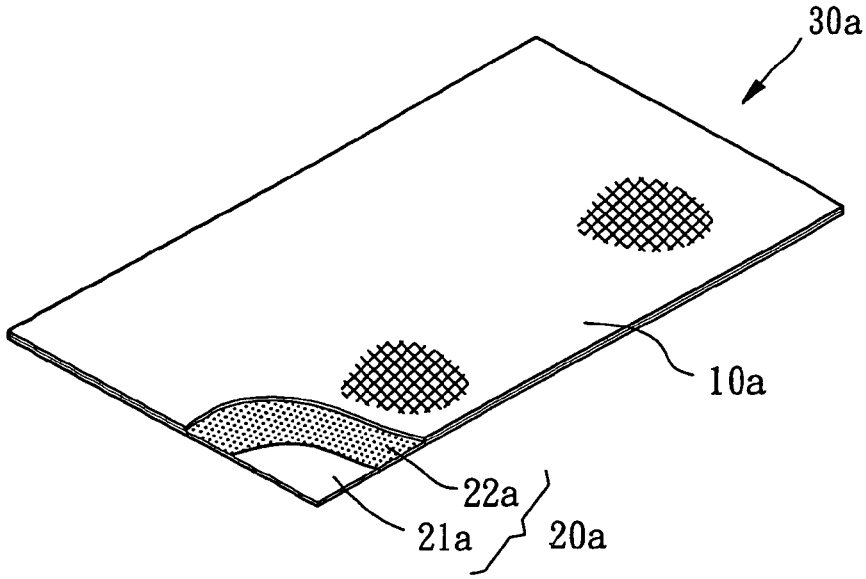
Figure 4A:
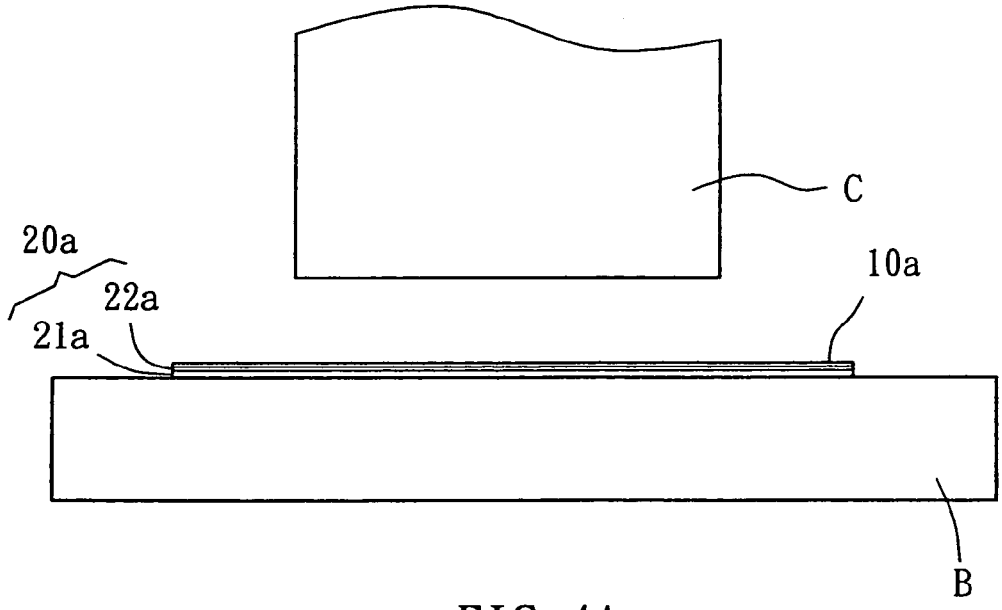
FIGS. 4A and 4B are schematic drawings showing the performance of step d) of the method of making the flexible sheet heater according to the preferred embodiment of the present invention.
Figure 4B:
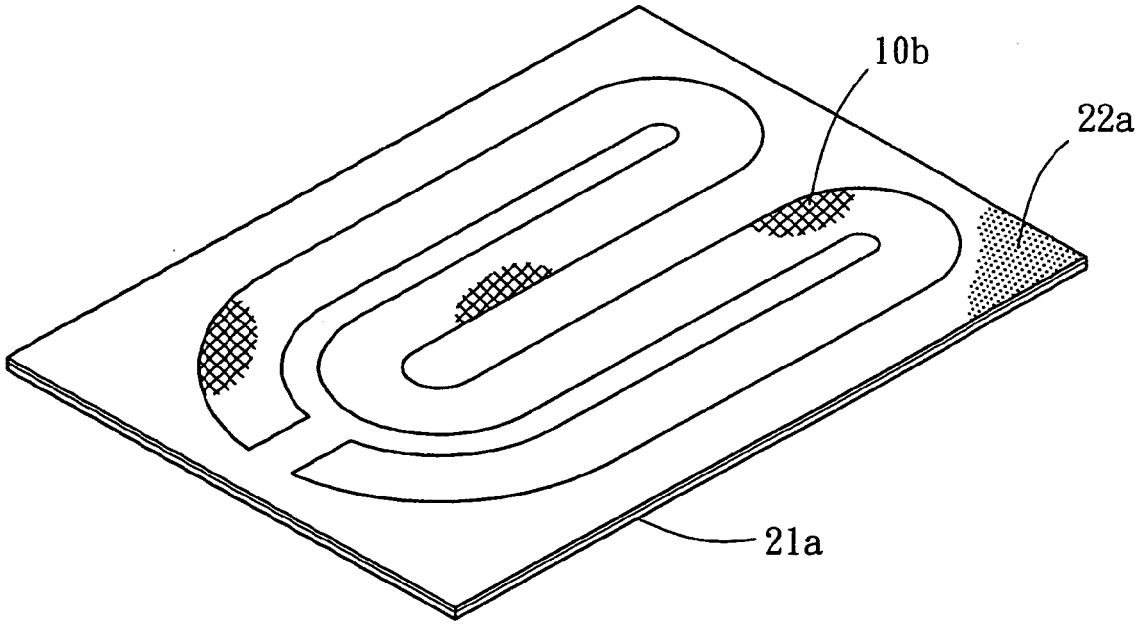
Figure 5:
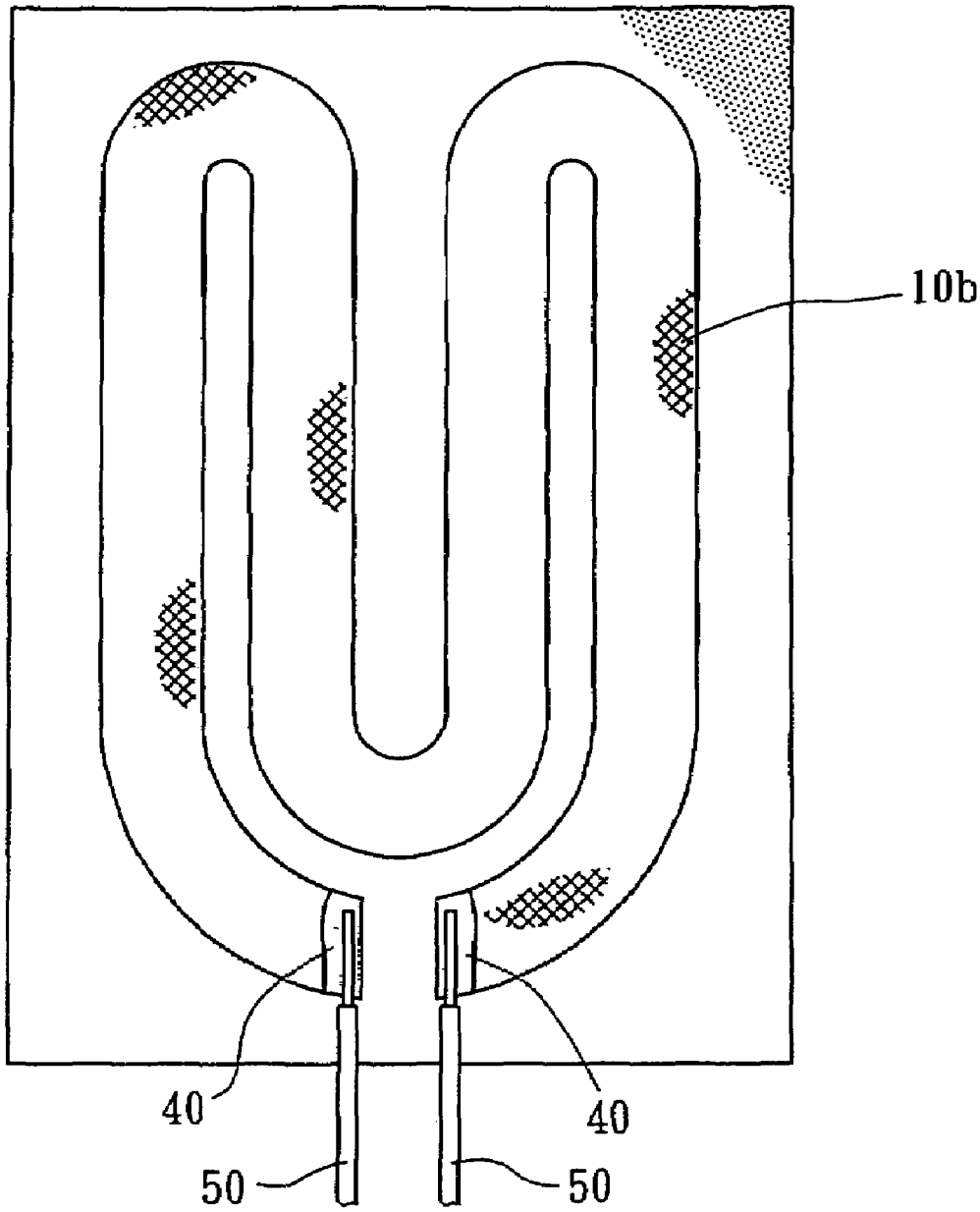
FIG. 5 illustrates the product obtained after step e) of the method of making the flexible sheet heater according to the preferred embodiment of the present invention.
Figure 6A:
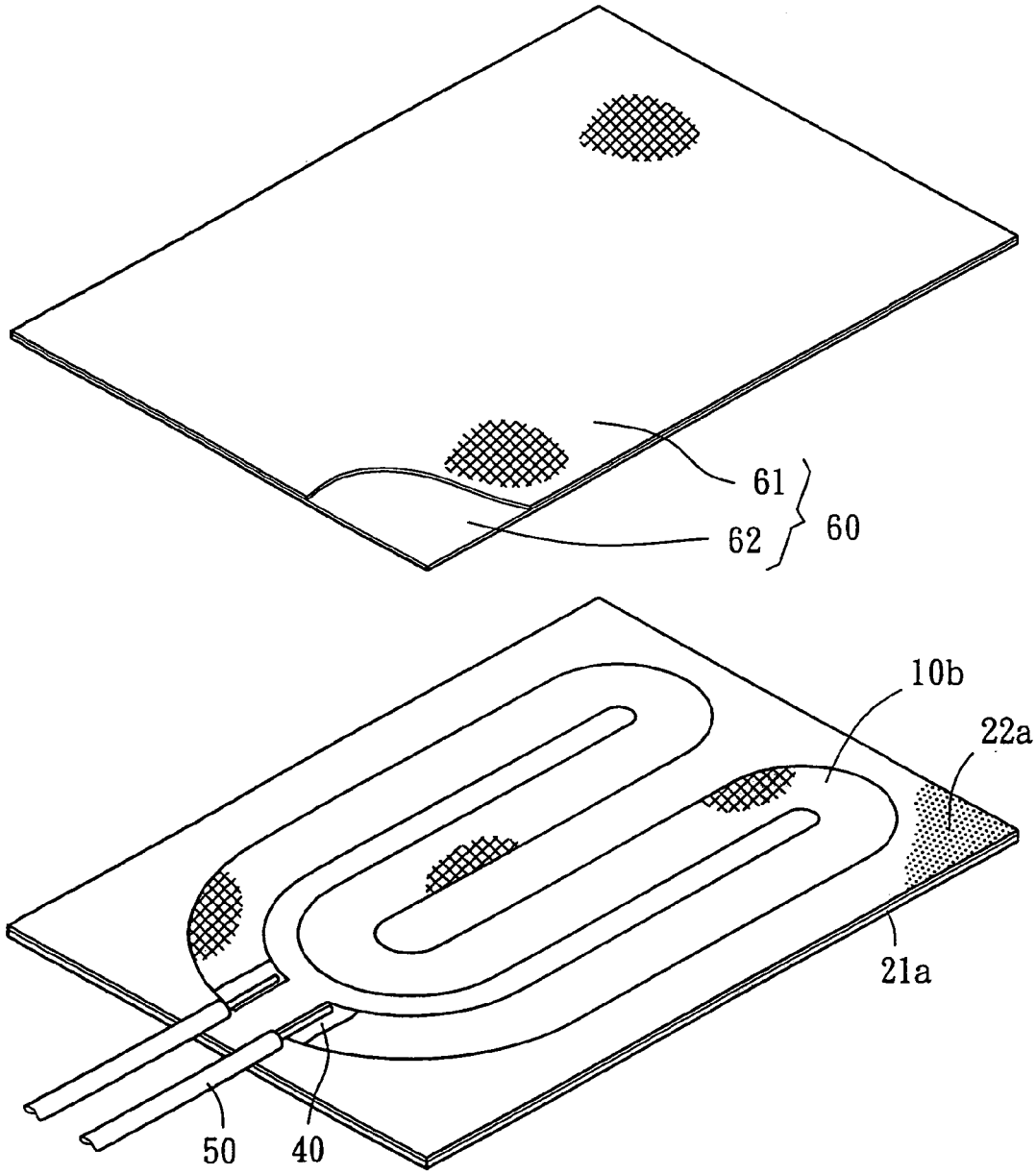
FIGS. 6A and 6B are schematic drawings showing the performance of step f) of the method of making the flexible sheet heater according to the preferred embodiment of the present invention.
Figure 6B:
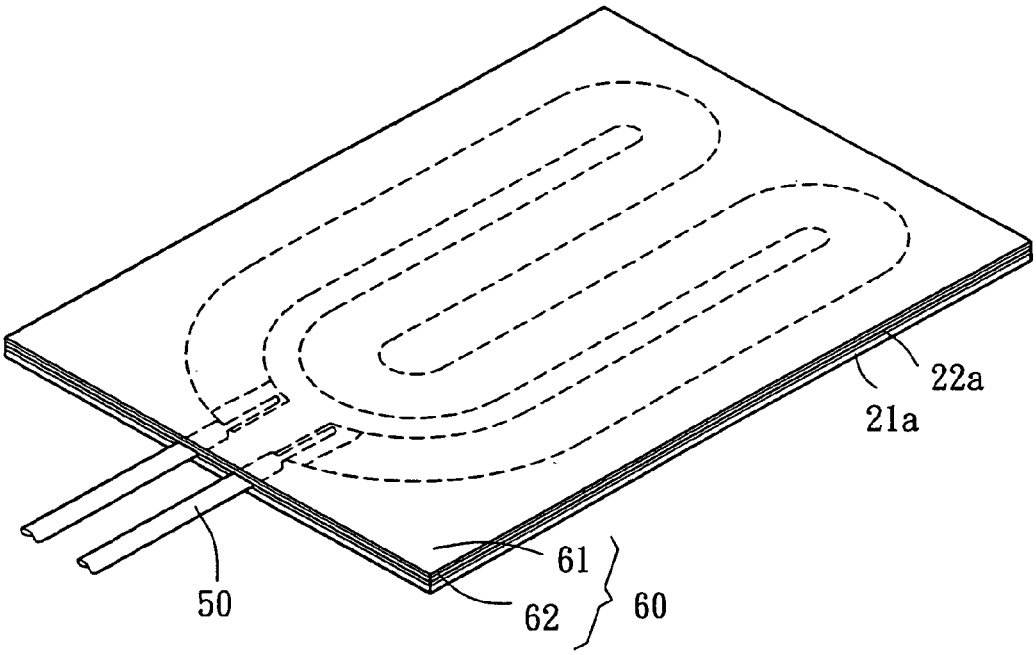
Figure 7:
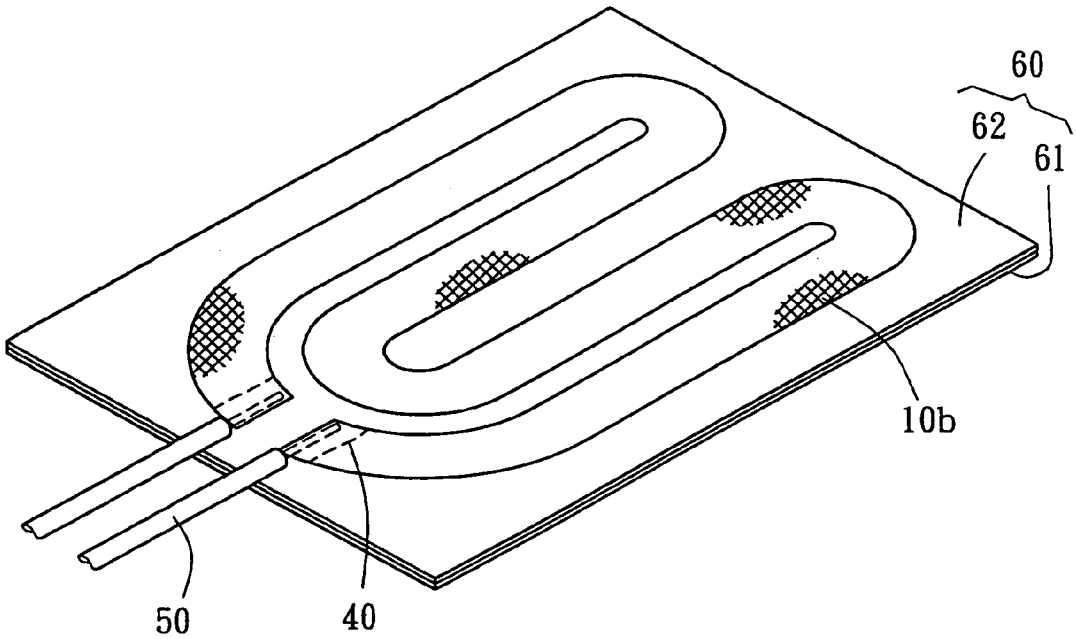
FIG. 7 illustrates the product obtained after step g) of the method of making the flexible sheet heater according to the preferred embodiment of the present invention.
Figure 8A:
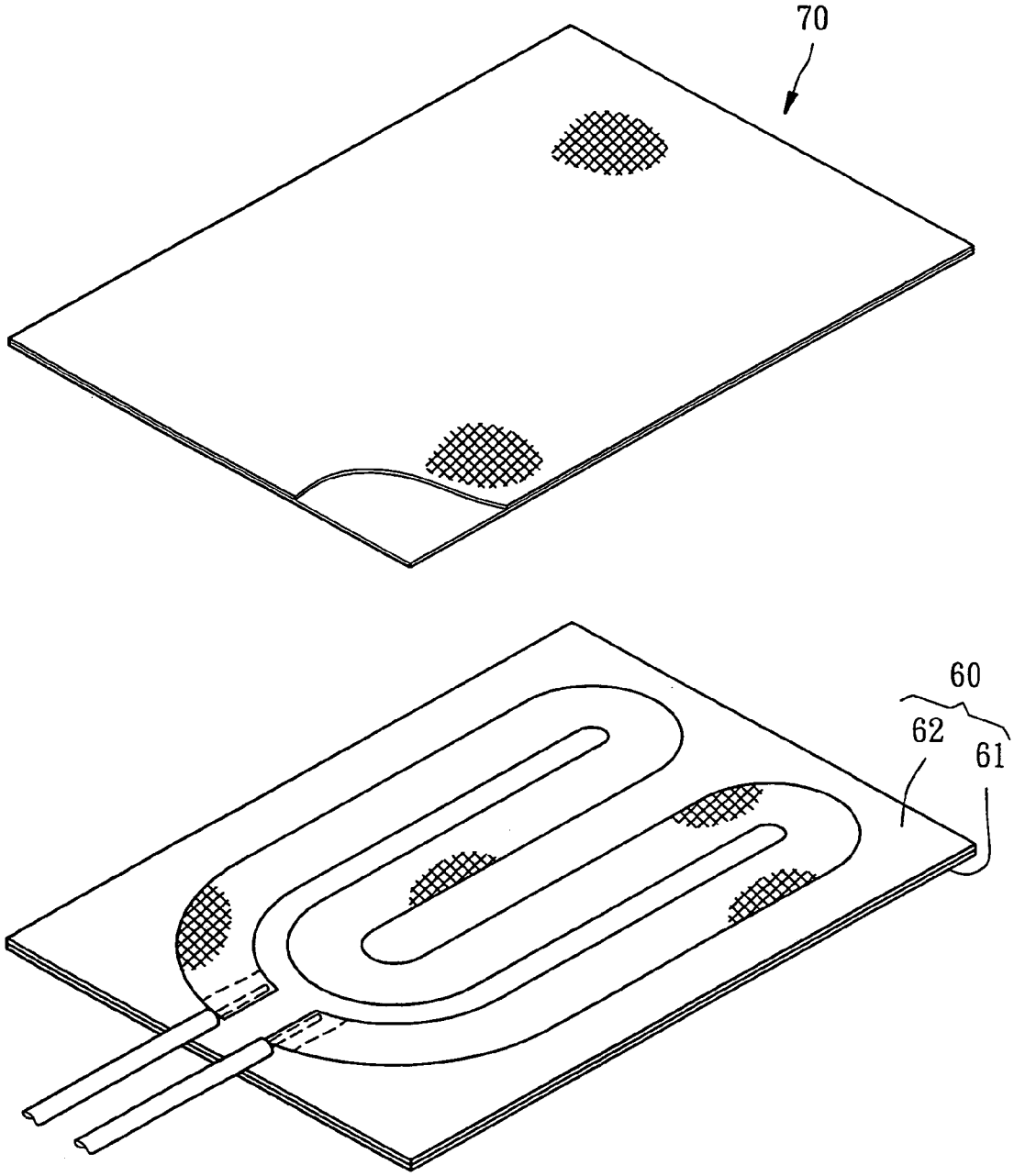
FIGS. 8A and 8B are schematic drawings showing the performance of step h) of the method of making the flexible sheet heater according to the preferred embodiment of the present invention.
Figure 8B:
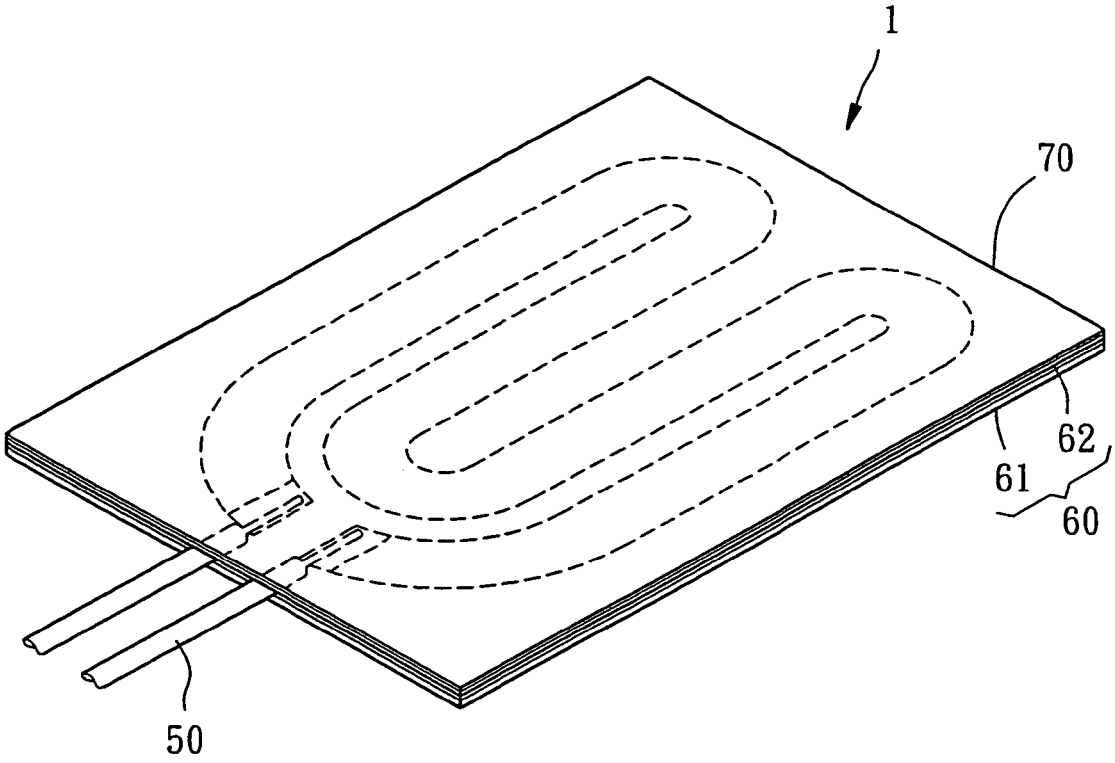

Referring to FIG. 1, the method of making a flexible sheet heater in accordance with a preferred embodiment of the present invention comprises the following steps.

a) Prepare an electrically conductive fabric 10. As shown in FIG. 3A, the electrically conductive fabric is a roll of carbon fiber fabric.

b) Prepare a support member 20. As shown in FIGS. 2 and 3A, the support member 20 is a roll of member comprising a polyethylene terephthalate (PET) film 21 and a layer of acrylic glue 22 covered on one side of the PET film 21.

c) Join the electrically conductive fabric 10 and the support member 20 together. As shown in FIG. 3A, the electrically conductive fabric 10 and the support member 20 are delivered along a predetermined path through the gap in between two rollers A for enabling the acrylic glue 22 at one side of the PET film 21 of the support member 20 to be bonded to one side of the electrically conductive fabric 10 so that the electrically conductive fabric 10 and the support member 20 are joined together and rolled up, thereby forming a roll of synthetic sheet member 30, which is then properly cut into a substrate 30*a*, as shown in FIG. 3B, subject to a predetermined shape and size for further processing.

d) Stamp the electrically conductive fabric 10*a* of the substrate 30*a* subject to a predetermined loop pattern, thereby forming a heating element 10*b* on the support member 20*a* of the substrate 30*a*. As shown in FIGS. 4A-4B, the substrate 30*a* is put on the worktable B of a stamping press with the electrically conductive fabric 10*a* facing the cutter C of the stamping press, and then the stamping press is operated to stamp the cutter C against the electrically conductive fabric 10*a* without touching the PET film 21*a* of the support member 20*a* of the substrate 30*a* so as to cut the electrically conductive fabric 10*a* into a heating element 10*b* having two distal ends subject to a predetermined loop pattern. Because the electrically conductive fabric 10*a* is bonded to the PET film 21*a*, the PET film 21*a* gives a support to the electrically conductive fabric 10*a*, so that the interlacing fiber structure of the electrically conductive fabric 10*a* does not disperse and the loop pattern of the heating element 10*b* is well kept in shape when the electrically conductive fabric 10*a* is cut and stretched by the cutter C.

e) Apply a conducting glue 40 to each of the two distal ends of the heating element 10*b* and fixedly bond a respective electrical terminal 50 to the conducting glue 40 at each of the two distal ends of the heating element 10*b* as shown in FIG. 5.

f) Bond a first flexible protective sheet member 60 to one side of the heating element 10*b* opposite to the PET film 21*a*. The first flexible protective sheet member 60 is formed of a waterproof fabric layer 61 and a thermoplastic layer 62 bonded to one side of the heating element 10*b* opposite to the PET film 21*a* by a hot press, as shown in FIGS. 6A and 6B. The waterproof fabric layer 61 can be formed of natural or synthetic fibers or other material such as glass fiber or metal, and the thermoplastic layer 62 can be formed of nylon, polyurethane, polyvinyl chloride or polyester.

g) Remove the PET film 21*a* from the heating element 10*b* as shown in FIG. 7. When the PET film 21*a* is removed from the heating element 10*b*, the acrylic glue 22*a* is separated with the PET film 21*a* from the heating element 10*b* without leaving any residue at the heating element 10*b* due to the acrylic material property.

h) Bond a second flexible protective sheet member 70 to the other side of the heating element 10*b* opposite to the first flexible protective sheet member 60. As shown in FIGS. 8A and 8B, the second flexible protective sheet member 70 of same structure as the first flexible protective sheet member 60 is bonded to the other side of the heating element 10*b* opposite to the first flexible protective sheet member 60 by a hot press to have the thermoplastic layer 62 of the first flexible protective sheet member 60 and the thermoplastic layer of the second flexible protective sheet member 70 be bonded together, thereby forming the desired flexible sheet heater 1.

Because the invention uses the support member 20*a* to support the electrically conductive fabric 10*a* for processing, the interlacing fiber structure of the electrically conductive fabric 10*a* does not disperse and the loop pattern of the heating element 10*b* is well kept in shape when the electrically conductive fabric 10*a* is cut and stretched by the cutter during the stamping operation. More particularly, the support member 20*a* of the invention uses the PET film 21*a* and the acrylic glue 22*a* as elements thereof, no residual acrylic glue will be left on the heating element 10*b* after removing of the PET film 21*a* from the heating element 10*b*.

Further, by means of the support of the support member 20*a*, the heating element 10*b* can be smoothly adhered to and supported on the first flexible protective sheet member 60 so that the heating element 10*b* can further be smoothly sandwiched in between the first flexible protective sheet member 60 and the second flexible protective sheet member 70.

What is claimed is:

1. A method of making a flexible sheet heater comprising the steps of:

a) preparing an electrically conductive fabric;

b) preparing a support member having a PET film and a layer of acrylic glue covered on one side of said PET film;

c) joining said electrically conductive fabric and said support member together by adhering said layer of acrylic glue to one side of said electrically conductive fabric by pressure;

d) cutting said electrically conductive fabric to form a heating element having a predetermined loop pattern by a stamping process;

e) applying a conducting glue to each of two distal ends of said heating element and fixedly bonding a respective electrical terminal to the conducting glue at each of the two distal ends of said heating element;

f) bonding a first flexible protective sheet member to one side of said heating element opposite to said PET film through a hot press;

g) removing said PET film from said heating element; and h) bonding a second flexible protective sheet member to one side of said heating element opposite to said first flexible protective sheet member.

2. The method as claimed in claim 1, wherein said electrically conductive fabric is a carbon fiber fabric.

3. The method as claimed in claim 1, wherein the electrically conductive fabric prepared in step a) is a roll of carbon fiber fabric; the support member prepared in step b) is a roll of PET film covered with a layer of acrylic glue on one side thereof; said step c) joining said electrically conductive fabric and said support member together is performed in such a manner that said electrically conductive fabric and said support member are delivered along a predetermined path through the gap in between two rollers for enabling the acrylic glue at one side of the PET film of said support member to be bonded to one side of said electrically conductive fabric so that said electrically conductive fabric and said support member are joined together and rolled up, thereby forming a roll of synthetic sheet member, which is then cut into a substrate subject to a predetermined shape and size for further processing in said step d).

4. The method as claimed in claim 1, wherein said first flexible protective sheet member is formed of a waterproof fabric layer and a thermoplastic layer covered on one side of said waterproof fabric layer for bonding to one side of said heating element opposite to said PET film.

5. The method as claimed in claim 4, wherein said second flexible protective sheet member is formed of a waterproof fabric layer and a thermoplastic layer covered on one side of said waterproof fabric layer for bonding to one side of said heating element opposite to said first flexible protective sheet member.

* * * * *